United States Patent [19]

Inoue et al.

[11] Patent Number: 4,788,946

[45] Date of Patent: Dec. 6, 1988

[54] VALVE OPERATING MECHANISM FOR INTERNAL COMBUSTION ENGINE

[75] Inventors: Kazuo Inoue; Kenichi Nagahiro; Yoshio Ajiki; Masaaki Katoh, all of Saitama, Japan

[73] Assignee: Honda Giken Kogyo Kabushiki Kaisha, Tokyo, Japan

[21] Appl. No.: 8,740

[22] Filed: Jan. 30, 1987

[51] Int. Cl.[4] ..... F01L 1/34; F01L 1/08; F01L 1/18

[52] U.S. Cl. ..... 123/90.16; 123/90.17; 123/90.6; 123/90.4

[58] Field of Search ..... 123/90.15, 90.16, 90.17, 123/90.44, 198 F, 90.4, 90.18, 90.6

[56] References Cited

U.S. PATENT DOCUMENTS

| | | | |
|---|---|---|---|
| 1,556,410 | 10/1925 | Boyer | 123/90.18 |
| 4,211,192 | 7/1980 | Baumgartner et al. | 123/90.6 |
| 4,448,156 | 5/1984 | Henault | 123/90.17 |
| 4,612,884 | 9/1986 | Ajiki et al. | 123/90.16 |
| 4,656,977 | 4/1987 | Nagahiro et al. | 123/90.16 |
| 4,690,110 | 9/1987 | Nishimura et al. | 123/90.4 |

*Primary Examiner*—Willis R. Wolfe

*Attorney, Agent, or Firm*—Lyon & Lyon

[57] ABSTRACT

A valve operating mechanism for operating a plurality of valves of an internal combustion engine includes a camshaft rotatable in synchronism with rotation of the internal combustion engine and having an array of three cams including a high-speed cam positioned at one end of the array. Three cam followers are held in sliding contact with the cams, respectively, for operating the valves according to cam profiles of the cams. The cam followers are selectively interconnected and disconnected to operate the valves at different valve timings in different speed ranges of the internal combustion engine. The speed ranges include a high-speed range in which all of the valves are controlled by the cam profile of the high-speed cam. The three cams may include low- and medium-speed cams, or two identical or different low-speed cams, in addition to the high-speed cam. These cams may be differently arranged in the array, and the cam followers include those which slidably engage one or two of the cams for operating the valves. The valves are operated selectively in low- and high-speed ranges, or in low-, medium-, and high-speed ranges, with different combinations of the cams.

17 Claims, 6 Drawing Sheets

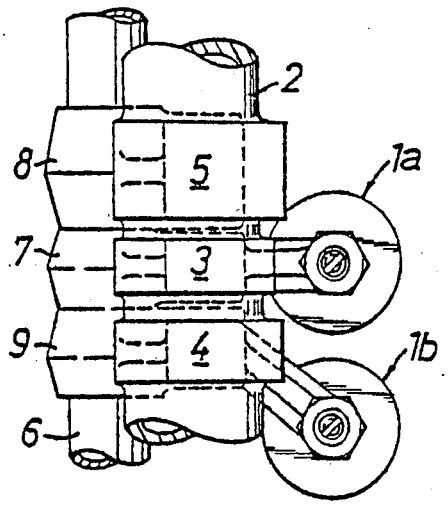
FIG. 10.
FIG. 12.
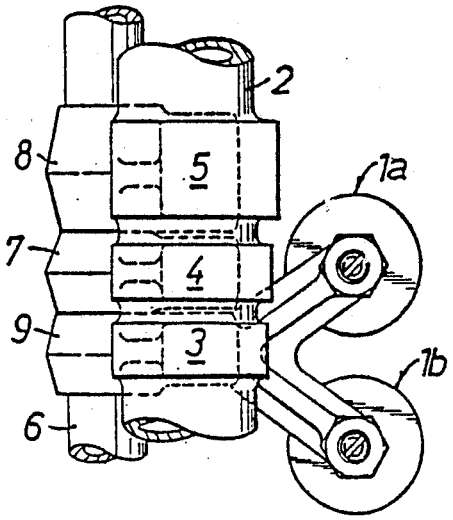
FIG. 11.
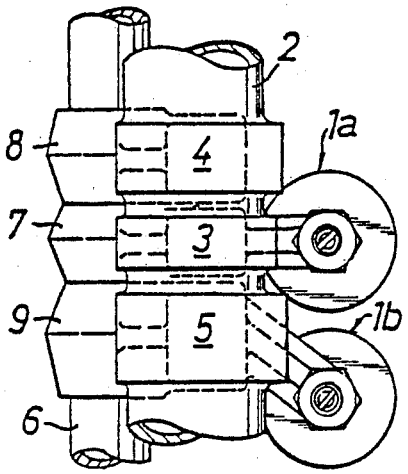

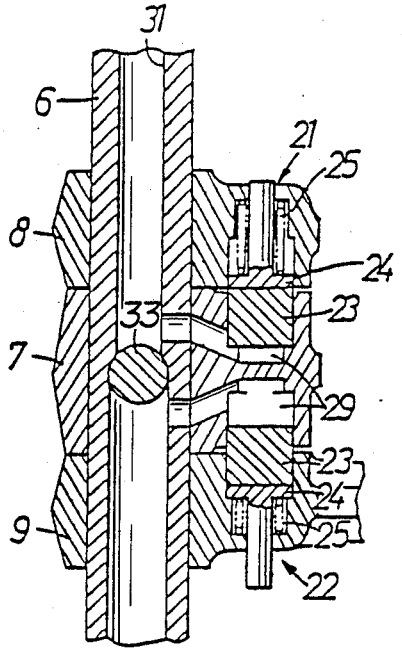
FIG. 13.
FIG. 15.
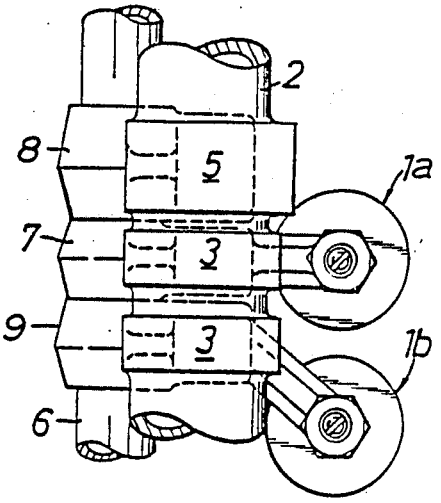
FIG. 14.
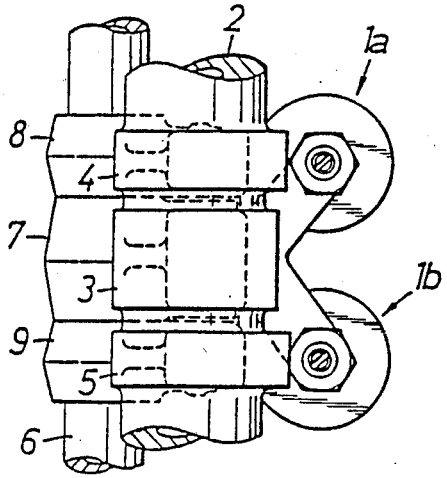

VALVE OPERATING MECHANISM FOR INTERNAL COMBUSTION ENGINE

BACKGROUND OF THE INVENTION

The present invention relates to a valve operating mechanism for an internal combustion engine, including a camshaft rotatable in synchronism with the rotation of the internal combustion engine and having integral cams for operating a pair of intake or exhaust valves, and rocker arms or cam followers angularly movably supported on a rocker shaft for opening and closing the intake or exhaust valves in response to rotation of the cams.

Valve operating mechanisms used in internal combustion engines are generally designed to meet requirements for high-speed operation of the engines. The valve diameter and valve lift are selected to efficiently introduce an air-fuel mixture required to produce maximum engine power in a certain engine speed range.

If an intake valve is actuated at constant valve timing and valve lift throughout a full engine speed range from low to high speeds, then the speed of flow of an air-fuel mixture into the combustion chamber varies from engine speed to engine speed since the amount of air-fuel mixture varies from engine speed to engine speed. At low engine speeds, the speed of flow of the air-fuel mixture is lowered and the air-fuel mixture is subject to less turbulence in the combusion chamber, resulting in slow combustion therein. Therefore, the combustion efficiency is reduced and so is the fuel economy, and the knocking margin is lowered due to the slow combustion.

One solution to the above problems is disclosed in Japanese Laid-Open Patent Publication No. 59(1984)-226216. According to the disclosed arrangement, some of the intake or exhaust valves remain closed when the engine operates at a low speed, whereas all of the intake or exhaust valves are operated, i.e., alternately opened and closed, during high-speed operation of the engine. Therefore, the valves are controlled differently in low- and high-speed ranges. However, if the valve control were effected in different modes in more speed ranges, the engine output power would be increased and the fuel economy would be improved.

SUMMARY OF THE INVENTION

It is an object of the present invention to provide a valve operating mechanism for an internal combustion engine, which controls valves in various different speed ranges for increased engine power and fuel economy.

According to the present invention, there is provided a valve operating mechanism for operating a plurality of valves of an internal combustion engine, comprising a camshaft rotatable in synchronism with rotation of the internal combustion engine and having an array of three cams including a high-speed cam positioned cam followers held in at one end of the array, three sliding contact with the cams, respectively, for operating the valves according to cam profiles of the cams, and means for selectively interconnecting and disconnecting the cam followers to operate the valves at different valve timings in different speed ranges of the internal combustion engine, the speed ranges including a high-speed range in which all of the valves are controlled by the cam profile of the high-speed cam.

The three cams may include low- and medium-speed cams, or two identical or different low-speed cams, in addition to the high-speed cam. These cams may be differently arranged in the array, and the cam followers include those which slidably engage, one or two of the cams for operating the valves. The valves are operated selectively in low- and high-speed ranges, or in low-, medium-, and high-speed ranges, with different combinations of the cams.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIGS. 9 through 17 are views of valve operating mechanisms according to other embodiments of the present invention.

DESCRIPTION OF THE PREFERRED EMBODIMENTS

Figure 1:
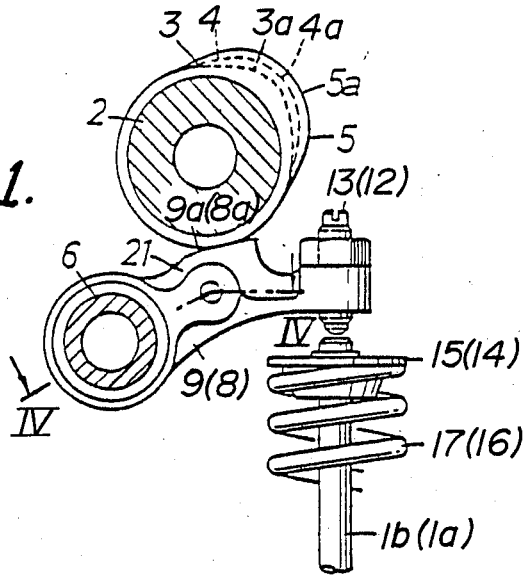
FIG. 1 is a vertical cross-sectional view of a valve operating mechanism according to an embodiment of the present invention, the view being taken along line I—I of FIG. 2.

Like or corresponding parts are denoted by like or corresponding reference characters throughout several views.

Figure 2:
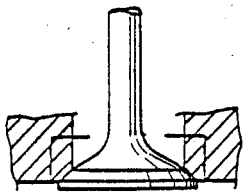
FIG. 2 is a plan view of the valve operating mechanism shown in FIG. 1.

FIGS. 1 and 2 show a valve operating mechanism according to an embodiment of the present invention. The valve operating mechanism is incorporated in an internal combustion engine including a pair of intake valves 1*a*, 1*b* in each engine cylinder for introducing an air-fuel mixture into a combustion chamber defined in an engine body.

The valve operating mechanism comprises a camshaft 2 rotatable in synchronism with rotation of the engine at a speed ratio of ½ with respect to the speed of rotation of the engine. The camshaft 2 has an array of a low-speed cam 3, a medium-speed cam 4, and a high-speed cam 5 which are integrally disposed on the circumference of the camshaft 2. The valve operating mechanism also has a rocker shaft 6 extending parallel to the camshaft 2, and first through third rocker arms or cam followers 7, 8, 9 angularly movably supported on the rocker shaft 6 and held against the medium-speed cam 4, the low-speed cam 3, and the high-speed cam 5, respectively, on the camshaft 2. The intake valves 1*a*, 1*b* are selectively operated by the first through third cam followers 7, 8, 9 actuated by the low-medium and high-speed cams 3, 4, 5.

The camshaft 2 is rotatably disposed above the engine body. The medium-speed cam 4 is disposed in a position corresponding to an intermediate position between the intake valves 1*a*, 1*b*, as viewed in FIG. 2. The low-speed cam 3 and the high-speed cam 5 are disposed one on each side of the medium-speed cam 4. Stated otherwise, the high-speed cam 5 is positioned at one end of the cam array. The low-speed cam 3 has a cam lobe 3*a* projecting radially outwardly from its base circle, and the medium-speed cam 4 has a cam lobe 4*a* projecting radially outwardly from its base circle to a greater extent than the cam lobe 3*a*, with the cam lobe 4*a* also having a larger angular extent than the cam lobe 3*a*. The high-speed cam 5 has a cam lobe 5*a* projecting radially outwardly from its base circle to a greater extent than the cam lobe 4*a*, with the cam lobe 5*a* also having a larger angular extent than the cam lobe 4*a*.

The rocker shaft 6 is fixed below the camshaft 2. The first cam follower 7 pivotally supported on the rocker shaft 6 is aligned with the medium-speed cam 4, the second cam follower 8 pivotally supported on the rocker shaft 6 is aligned with the low-speed cam 3, and the third cam follower 9 pivotally supported on the rocker shaft 6 is aligned with the high-speed cam 5. The cam followers 7, 8, 9 have on their upper surfaces cam slippers 7*a*, 8*a*, 9*a*, respectively, held in sliding contact with the cams 4, 3, 5, respectively. The second and third cam followers 8, 9 have distal ends positioned above the intake valves 1*a*, 1*b*, respectively. Tappet screws 12, 13 are threaded through the distal ends of the second and third cam followers 8, 9 and have tips engagable respectively with the upper ends of the valve stems of the intake valves 1*a*, 1*b*.

Flanges 14, 15 are attached to the upper ends of the valve stems of the intake valves 1*a*, 1*b*. The intake valves 1*a*, 1*b* are normally urged to close the intake ports by compression coil springs 16, 17 disposed under compression around the valve stems between the flanges 14, 15 and the engine body.

Figure 3:
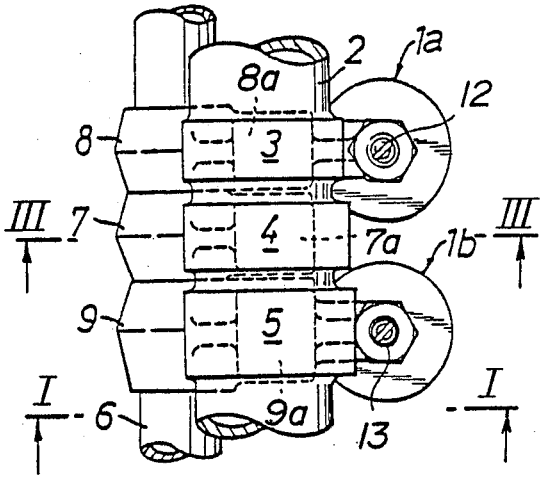
FIG. 3 is a cross-sectional view taken along line III—III of FIG. 2.
Figure 3:
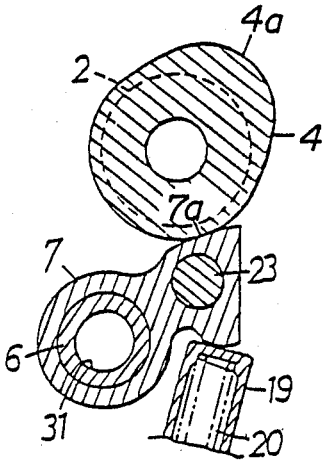

As shown in FIG. 3, a bottomed cylindrical lifter 19 is disposed in abutment against a lower surface of the first cam follower 7. The lifter 19 is normally urged upwardly by a compression spring 20 of relatively weak resiliency interposed between the lifter 19 and the engine body for resiliently biasing the cam slipper 7*a* of the first cam follower 7 slidably against the medium-speed cam 4.

Figure 4:
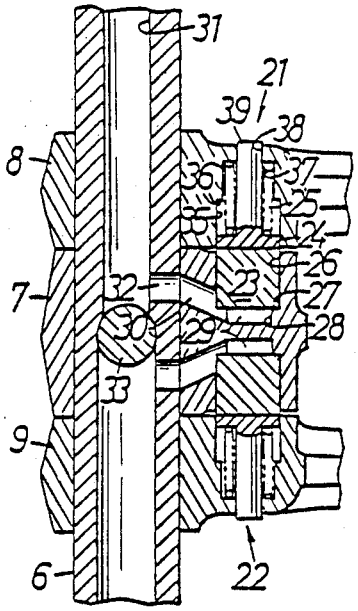
FIG. 4 is a cross-sectional view taken along line IV—IV of FIG. 1, showing first through third cam followers disconnected from each other.

As illustrated in FIG. 4, the first and second cam followers 7, 8 have confronting side walls held in sliding contact with each other. A first selective coupling 21 is operatively disposed in and between the first and second cam followers 7, 8 for selectively disconnecting the cam followers 7, 8 from each other for relative displacement and also for interconnecting the cam followers 7, 8 for their movement in unison. Likewise, the first and third cam followers 7, 9 have confronting side walls held in sliding contact with each other. A second selective coupling 22 is operatively disposed in and between the first and third cam followers 7, 9 for selectively disconnecting the cam followers 7, 9 from each other for relative displacement and also for interconnecting the cam followers 7, 9 for their movement in unison.

The first and second selective couplings 21, 22 are of an identical construction, and hence only the first selective coupling 21 will hereinafter be described in detail.

The first selective coupling 21 comprises a piston 23 movable between a position in which it interconnects the first and second cam followers 7, 8 and a position in which it disconnects the first and second cam followers 7, 8 from each other, a circular stopper 24 for limiting the movement of the piston 23, and a coil spring 25 for urging the stopper 24 to move the piston 23 toward the position to disconnect the first and second cam followers 7, 8 from each other.

The first cam follower 7 has a first guide hole 26 opening toward the second cam follower 8 and extending parallel to the rocker shaft 6. The first cam follower 7 also has a smaller-diameter hole 28 near the closed end of the first guide hole 26, with a step or shoulder 27 being defined between the smaller-diameter hole 28 and the first guide hole 26. The piston 23 is slidably fitted in the first guide hole 26. The piston 23 and the closed end of the smaller-diameter hole 28 define therebetween a hydraulic pressure chamber 29.

The first cam follower 7 has an hydraulic passage 30 defined therein in communication with the hydraulic pressure chamber 29. The rocker shaft 6 has a hydraulic passage 31 defined axially therein and coupled to a source (not shown) of hydraulic pressure through a suitable hydraulic pressure control mechanism. The hydraulic passages 30, 31 are held in communication with each other through a hole 32 defined in a side wall of the rocker shaft 6, irrespective of how the first cam follower 7 is angularly moved about the rocker shaft 6.

The second cam follower 8 has a second guide hole 35 opening toward the first cam follower 7 in registration with the first guide hole 26 in the first cam follower 7. The circular stopper 24 is slidably fitted in the second guide hole 35. The second cam follower 8 also has a smaller-diameter hole 37 near the closed end of the second guide hole 35, with a step or shoulder 36 defined between the second guide hole 35 and the smaller-diameter hole 37 for limiting movement of the circular stopper 24. The second cam follower 8 also has a through hole 38 defined coaxially with the smaller-diameter hole 37. A guide rod 39 joined integrally and coaxially to the circular stopper 24 extends through the hole 38. The coil spring 25 is disposed around the guide rod 39 between the stopper 24 and the closed end of the smaller-diameter hole 37.

The piston 23 has an axial length selected such that when one end of the piston 23 abuts against the step 27, the other end thereof is positioned just between and hence lies flush with the sliding side walls of the first and second cam followers 7, 8, and when the piston 23 is moved into the second guide hole 35 until it displaces the stopper 24 into abutment against the step 36, said one end of the piston 23 remains hence in the first guide hole 26 and the piston 23 extends between the first and second cam followers 7, 8.

The hydraulic passages 31 communicating with the first and second selective couplings 21, 22 are isolated from each other by a steel ball 33 forcibly fitted and fixedly positioned in the rocker shaft 6. Theretore, the first and second selective couplings 21, 22 are operable under hydraulic pressure independently of each other.

Operation of the valve operating mechanism will be described with reference to FIGS. 4 through 6. When the engine is to operate in a low-speed range, the first and second selective couplings 21, 22 are actuated to disconnect the first through third cam followers 7, 8, 9 from each other as illustrated in FIG. 4. More specifically, the hydraulic pressure is released by the hydraulic pressure control mechanism from the hydraulic pressure chamber 29, thus allowing the stopper 24 to move toward the first cam follower 7 under the resiliency of the spring 25 until the piston 23 abuts against the step 27. When the piston 23 engages the step 27, the mutually contacting ends of the piston 23 and the stopper 24 of the first selective coupling 21 lie flush with the sliding side walls of the first and second cam followers 7, 8. Likewise, the mutually contacting ends of the piston 23 and the stopper 24 of the second selective coupling 22 lie flush with the sliding side walls of the first and third cam followers 7, 9. Thus, the first, second, and third cam followers 7, 8, 9 are held in mutually sliding contact for relative angular movement.

With the first through third cam followers 7, 8, 9 being thus disconnected, the second and third cam followers 8, 9 are not affected by the angular movement of the first cam follower 7 in sliding contact with the medium-speed cam 4. The second cam follower 8 is angularly moved in sliding contact with the low-speed cam 3, whereas the third cam follower 9 is angularly moved in sliding contact with the high-speed cam 5. Therefore, the intake valve 1*a* is alternately opened and closed by the second cam follower 8, and the other intake valve 1*b* is alternately opened and closed by the third cam follower 9. Any frictional loss of the valve operating mechanism is relatively low because the first cam follower 7 is held in sliding contact with the medium-speed cam 4 under the relatively small resilient force of the spring 20.

During low-speed operation of the engine, therefore, the intake valve 1*a* alternately opens and closes the intake port at the valve timing and valve lift according to the profile of the low-speed cam 3, whereas the other intake valve 1*b* alternately opens and closes the intake port at the valve timing and valve lift according to the profile of the high-speed cam 5. Accordingly, the air-fuel mixture flows into the combustion chamber at a rate suitable for the low-speed operation of the engine, resulting in improved fuel economy and prevention of knocking. Since the low- and high-speed cams 3, 5 have different cam profiles, the turbulence of the air-fuel mixture in the combustion chamber is increased to improve fuel economy. Inasmuch as the intake valves 1*a*, 1*b* are operated at all times, no carbon will be deposited between the intake valves 1*a*, 1*b* and their valve seats, and no fuel will be accumulated on the intake valves 1*a*, 1*b*.

Figure 5:
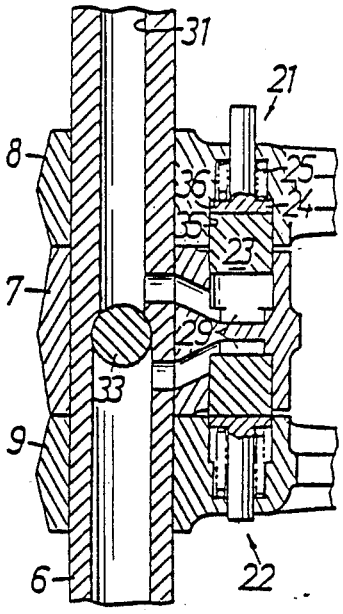
FIG. 5 is a cross-sectional view similar to FIG. 4, showing the first and second cam followers connected to each other.

For medium-speed operation of the engine, the first and second cam followers 7, 8 are interconnected by the first selective coupling 21, with the first and third cam followers 7, 9 remaining disconnected from each other, as shown in FIG. 5. More specifically, the hydraulic pressure chamber 29 of the first selective coupling 21 is supplied with hydraulic pressure to cause the piston 23 to push the stopper 24 into the second guide hole 35 against the resiliency of the spring 25 until the stopper 24 engages the step 36. The first and second cam followers 7, 8 are now connected to each other for angular movement in unison.

Therefore, the intake valve 1*a* alternately opens and closes the intake port at the valve timing and valve lift according to the profile of the medium-speed cam 4, whereas the other intake valve 1*b* alternately opens and closes the intake port at the valve timing and valve lift according to the profile of the high-speed cam 5. The air-fuel mixture now flows into the combustion chamber at a rate suitable for the medium-speed operation of the engine, resulting in greater turbulence of the air-fuel mixture in the combustion chamber-and hence in improved fuel economy.

Figure 6:
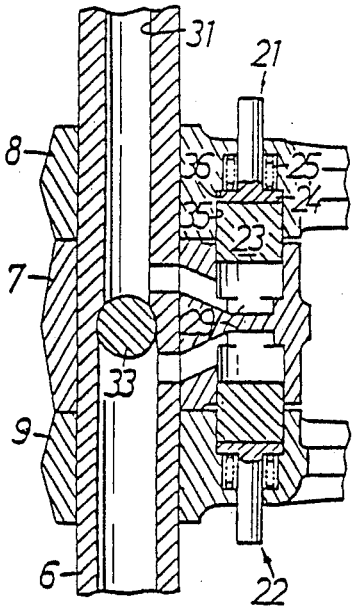
FIG. 6 is a cross-sectional view similar to FIG. 4, showing the first through third cam followers connected to each other.

When the engine is to operate at a high speed, the first and third cam followers 7, 9 are interconnected by the second selective coupling 22, as shown in FIG. 6, by supplying hydraulic pressure into the hydraulic pressure chamber 29 of the second selective coupling 22. Inasmuch as the first and second cam followers 7, 8 remain connected by the first selective coupling 21 at this time, the cam followers 7, 8, 9 are caused to swing by the high-speed cam 5. As a consequence, the intake valves 1*a*, 1*b* alternately open and close the respective intake ports at the valve timing and valve lift according to the profile of the high-speed cam 5. The intake efficiency is increased to enable the engine to produce higher output power and torque.

Figure 8:
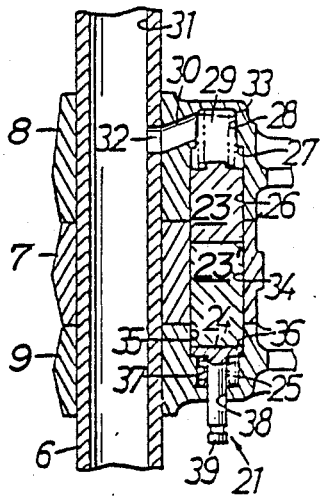
FIG. 8 is a cross-sectional view similar to FIG. 7, illustrating the first through third cam followers interconnected.
Figure 7:
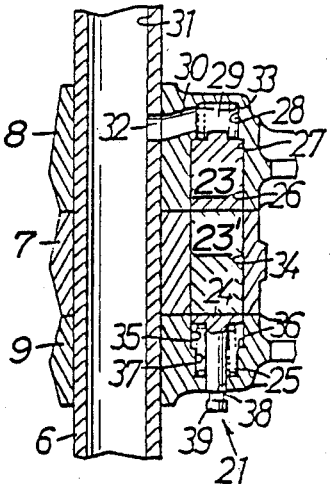
FIG. 7 is a cross-sectional view of a selective coupling according to another embodiment of the present invention, showing first through third cam followers disconnected from each other.

FIGS. 7 and 8 illustrate a selective coupling according to another embodiment. As shown in FIG. 7, the first, second, and third cam followers 7, 8, 9 have confronting slide walls held in mutual sliding contact. A selective coupling 21 is operatively disposed in and between the first through third cam followers 7, 8, 9 for selectively disconnecting the cam followers 7, 8, 9 from each other for relative displacement and also for interconnecting the cam followers 7, 8, 9 for their angular movement in unison.

The selective coupling 21 comprises a first piston 23 movable between a position in which it interconnects the first and second cam followers 7, 8 and a position in which it disconnects the first and second cam followers 7, 8 from each other, a second piston 23' movable between a position in which it interconnects the first and third cam followers 7, 9 and a position from each other, a circular stopper 24 for limiting the movement of the first and second pistons 23, 23' toward their positions to disconnect the first and second cam followers 7, 8 from each other and the first and third cam followers 7, 9 from each other.

The second cam follower 8 has a first guide hole 26 opening toward the first cam follower 7 and extending parallel to the rocker shaft 6. The second cam follower 8 also has a smaller-diameter hole 28 near the closed end of the first guide hole 26, with a step or shoulder 27 being defined between the smaller-diameter hole 28 and the first guide hole 26. The first piston 23 is slidably fitted in the first guide hole 26. The first piston 23 and the closed end of the smaller-diameter hole 28 define therebetween a hydraulic pressure chamber 29.

The second cam follower 8 has a hydraulic passage 30 defined therein in communication with the hydraulic pressure chamber 29. The rocker shaft 6 has a hydraulic passage 31 defined axially therein and coupled to a source (not shown) of hydraulic pressure through a suitable hydraulic pressure control mechanism. The hydraulic passages 30, 31 are held in communication with each other through a hole 32 defined in a side wall of the rocker shaft 6, irrespective of how the second cam follower 8 is angularly moved about the rocker shaft 6.

The first piston 23 has has an axial length selected such that when one end of the first piston 23 abuts against the step 27, the other end thereof is positioned just between and hence lies flush with the sliding walls of the first and second cam followers 7, 8 without projecting from the side wall of the second cam follower 8 toward the first cam follower 7. The first piston 23 is normally urged toward the first cam follower 7 under the resiliency of a coil spring 33 disposed in the hydraulic pressure chamber 29 and acting between the first piston 23 and the closed bottom of the smaller-diameter hole 28. The resilient force of the spring 33 set under compression in the hydraulic pressure chamber 29 is selected to be smaller than that of the spring 25 set in place under compression.

The first cam follower 7 has a guide hole 34 defined thereacross and extending between the opposite sides thereof in registration with the first guide hole 26 in the second cam follower 8. The second piston 23' is slidably fitted in the guide hole 34, the second piston 23' having a length equal to the full length of the guide hole 34. The second piston 23' has an outside diameter equal to that of the first piston 23'.

The third cam follower 9 has a second guide hole 35 opening toward the first cam follower 7 in registration with the guide hole 34. The circular stopper 24 is slidably fitted in the second guide hole 35. The third cam follower 9 also has a smaller-diameter hole 37 near the closed end of the second guide hole 35, with a step or shoulder 36 defined between the second guide hole 35 and the smaller-diameter hole 37 for limiting movement of the circular stopper 24. The third cam follower 9 also has a smaller-diameter through hole 38 defined coaxially with the smaller-diameter hole 37. A guide rod 39 joined integrally and coaxially to the circular stopper 24 extends through the hole 38. The coil spring 25 is disposed around the guide rod 39 between the stopper 24 and the closed end of the smaller-diameter hole 37.

The selective coupling 21 shown in FIGS. 7 and 8 operates as follows: When the engine is to operate in a low-speed range, no hydraulic pressure is supplied to the hydraulic pressure chamber 29, and the stopper 24 is forced by the spring 25 toward the first cam follower 7 until the first piston 23 is moved by the second piston 23' into abutment against the step 27. At this time, the mutually contacting ends of the first and second pistons 23, 23' lie flush with the confronting sliding side surfaces of the first and second cam followers 7, 8, and the mutually contacting ends of the second piston 23' and the stopper 24 lie flush with the confronting sliding side surfaces of the first and third cam followers 7, 9 as shown in FIG. 7. Therefore, the first through third cam followers 7, 8, 9 are relatively angularly movable while the first and second pistons 23, 23' and the second piston 23' and the stopper 24 are being in sliding contact with each other.

When the camshaft 2 is rotated about its own axis with the first through third cam followers 7, 8, 9 being thus disconnected by the selective coupling 21, the second cam follower 8 is angularly moved in sliding contact with the low-speed cam 3 (FIG. 2), whereas the third cam follower 9 is angularly moved in sliding contact with the high-speed cam 5. Therefore, the intake valves 1*a*, 1*b* are caused by the low- and high-speed cams 3, 5 to alternately open and close the respective intake ports. The angular movement of the first cam follower 7 in sliding contact with the medium speed cam 4 does not affect operation of the intake valves 1*a*, 1*b* in any way.

During low-speed operation of the engine, therefore, the intake valve 1*a* alternately opens and closes the intake port at the valve timing and valve lift according to the profile of the low-speed cam 3, whereas the intake valve 1*b* alternately opens and closes the intake port at the valve timing and valve lift according to the profile of the high-speed cam 5. Accordingly, the air-fuel mixture flows into the combustion chamber at a rate suitable for the low-speed operation of the engine, resulting in improved fuel economy and prevention of knocking. Since the cam profiles of the low- and high-speed cams 3, 5 are different from each other, the turbulence of the air-fuel mixture as it is supplied into the combustion chamber is increased for better fuel economy. Furthermore, inasmuch as both of the intake valves 1*a*, 1*b* are operated, no carbon will be deposited between the intake valves 1*a*, 1*b* and their valve seats, and no reduction in the sealing capability between the intake valves 1*a*, 1*b* and their valve seats will be encountered. In addition, no fuel will be accumulated on the intake valves 1*a*, 1*b*.

For high-speed operation of the engine, the hydraulic pressure is supplied to the hydraulic pressure chamber 29 to move the first piston 23 toward the first cam follower 7 against the resiliency of the spring 25, thereby displacing the second piston 23' toward the third cam follower 9. As a result, the first and second pistons 23, 23' are moved until the stopper 24 abuts against the step 36, as illustrated in FIG. 8. Consequently, the first and second cam followers 7, 8 are interconnected by the first piston 23 positioned therebetween, and the first and third cam followers 7, 9 are interconnected by the second piston 23' position therebetween.

The first and second cam followers 7, 8 are now caused to swing in unison with the third cam follower 9 since the third cam follower 9 is angularly moved to the greatest angular extent in sliding contact with the high-speed cam 5 (FIG. 2). The intake valves 1*a*, 1*b* alternately open and close the respective intake ports at the valve timing and valve lift according to the cam profile of the high-speed cam 5, so that the engine output power can be increased.

Figure 9:
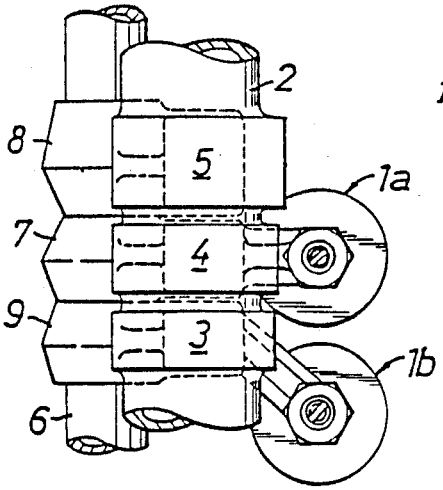

FIG. 9 shows another embodiment of the present invention which employs the selective coupling embodiment of FIGS. 4–6. The medium-speed cam 4 is disposed between the low- and high-speed cams 3, 5. The intake valves 1*a*, 1*b* are engaged by the first and third cam followers 7, 9, respectively, which are held in sliding contact with the medium- and low-speed cams 4, 3, respectively. The second cam follower 8 slidingly contacts the high-speed cam 5. In the low-speed range, the first through third cam followers 7, 8, 9 are disconnected from each other, and the intake valves 1*a*, 1*b* are operated at the valve timing and valve lift according to the profiles of the medium- and low-speed cams 4, 3, respectively. In the medium-speed range, the first and second cam followers 7, 8 are in interconnected with the first and third cam followers 7, 9 disconnected, and the intake valves 1*a*, 1*b* are operated at the valve timing and valve lift according to the profiles of the high- and low-speed cams 5, 3, respectively. In the high-speed range, the first through third cam followers 7, 8, 9 are interconnected, and the intake valves 1*a*, 1*b* are operated at the valve timing and valve lift according to the profile of the high-speed cam 5.

According to still another embodiment shown in FIG. 10, the low-speed cam 3 is disposed between the medium- and high-speed cams 4, 5. The intake valves 1*a*, 1*b* are engaged by the first and third cam followers 7, 9, respectively, which are held in sliding contact with the low- and medium-speed cams 3, 4, respectively. The second cam follower 8 slidingly contacts the high-speed cam 5. The embodiment of FIG. 10 also employs the selective coupling embodiment of FIGS. 4–6. In the low-speed range, the intake valves 1*a*, 1*b* are operated at the valve timing and valve lift according to the profiles of the low- and medium-speed range, the intake valves 1*a*, 1*b* are operated at the valve timing and valve lift according to the profiles of the high- and medium-speed cams 5, 4, respectively. In the high-speed range, the intake valves 1*a*, 1*b* are operated at the valve timing and valve lift according to the profile of the high-speed cam 5.

In a still further embodiment of FIG. 11, also employing the selective coupling of FIGS. 4–6, the low-speed cam 3 is disposed between the medium- and high-speed cams 4, 5. The intake valves 1*a*, 1*b* are engaged by the first and third cam followers 7, 9 respectively, which are held in sliding contact with the low- and high-speed cams 3, 5, respectively. The second cam follower 8 slidingly contacts the medium-speed cam 5. In the low-speed range, the intake valves 1*a*, 1*b* are operated at the valve timing and valve lift according to the profiles of the low- and high-speed cams 3, 5, repectively. In the medium-speed range, the intake valves 1*a*, 1*b* are operated at the valve timing and valve lift according to the profiles of the medium- and high-speed cams 4, 5, respectively. In the high-speed range, the intake valves 1*a*, 1*b* are operated at the valve timing and valve lift accordinf to the profile of the high-speed cam 5.

FIG. 12 illustrates another embodiment in which the medium-speed cam 4 is disposed between the low- and high-speed cams 3, 5. The first and second cam followers 7, 8 are held in sliding contact with the medium- and high-speed cams 4, 5, respectively, and the third cam follower 9 which engages both of the intake valves 1*a*, 1*b* can be controlled in two different speed ranges by the mechanism shown in FIGS. 7 and 8. Specifically, in the low-speed range, the intake valves 1*a*, 1*b* are operated by the low-speed cam 3, and, in the high-speed range, the intake valves 1*a*, 1*b* are operated by the high-speed cam 5. The intake valves 1*a*, 1*b* can also be controlled in a third speed range by the mechanism of FIGS. 4 through 6 by displacing the piston 23 of the second selective coupling 22 into the third cam follower 9 and keeping the piston 23 of the first selective coupling 21 within the first cam follower 7, as shown in FIG. 13, in the medium-speed range.

In FIG. 14 which shows still another embodiment, the low-speed cam 3 is disposed between the medium- and high-speed cams 4, 5. The second and third cam followers 8, 9 are held in sliding contact with the medium- and high-speed cams 4,5, respectively and the first cam follower 7 which engages both of the intake valves 1*a*, 1*b*, slidingly contacts the low-speed cam 3. The intake valves 1*a*, 1*b*, are controlled in different speed ranges by the mechanism shown in FIGS. 4 through 6. In the low-speed range, the intake valves 1*a*, 1*b*, are operated by the low-speed cam 3. In the medium-speed range, the intake valves 1*a*, 1*b* are operated by the medium-speed cam 4. In the high-speed range, the intake valves 1*a*, 1*b*, are operated by the high-speed cam 5.

According to a still further embodiment shown in FIG. 15, tow adjacent identical low-speed cams 3 are mounted on the camshaft 2 and the high-speed cam 5 is disposed at an end of the cam array. The first and second cam followers 7, 8 are held in sliding contact with one of the low-speed cams 3 and the high-speed cam 5, respectively, and the third cam follower 9 is held in sliding contact with the other low-speed cam 3. The intake valves 1*a*, 1*b*, are engaged by the first and third cam followers 7, 9, respectively. The intake valves 1*a*, 1*b*, are controlled in different speed ranges by the mechanism shown in FIG. 4 through 6 or FIGS. 7 and 8. In the low-speed range, the intake valves 1*a*, 1*b*, are operated by the respective low-speed cams 3. In the medium-speed range, the intake valves 1*a*, 1*b*, are operated by the high- and low-speed cams 5, 3, respectively if the mechanism of FIGS. 4–6 is used. In the high-speed range, the intake valves 1*a*, 1*b*, are operated by the high-speed cam 5.

Figure 16:
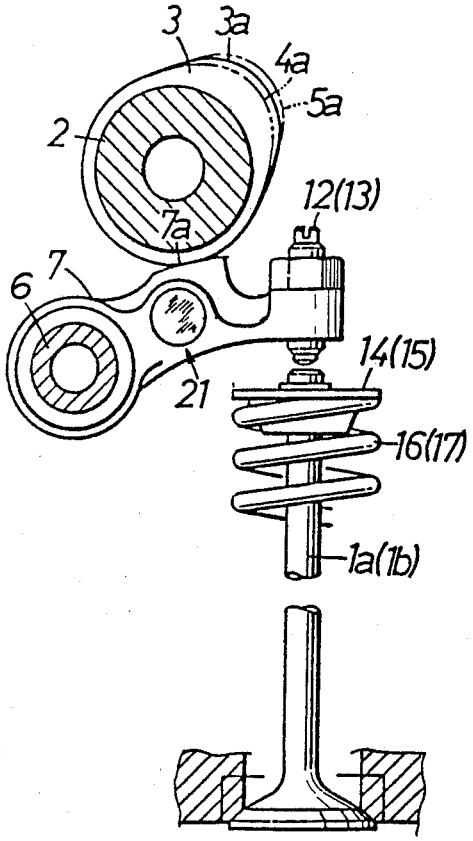
Figure 17:
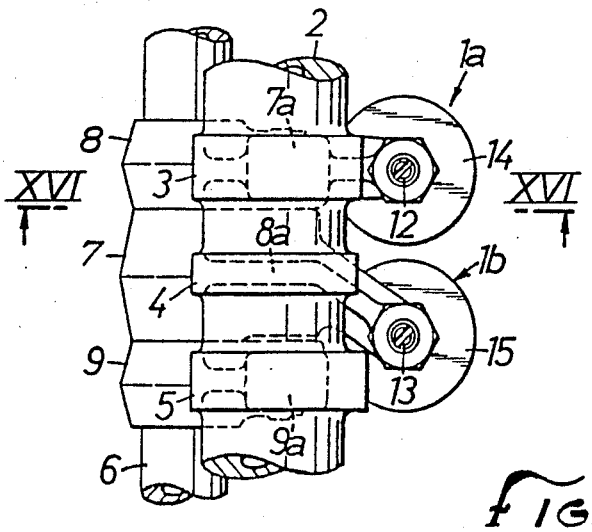

FIGS. 16 and 17 show a yet still further embodiment of the present invention. The camshaft 2 has first and second low-speed cams 3, 4 having cam lobes 3*a*, 4*b*, the cam lobe 3*a* being larger than the cam lobe 4*a* in radial projection. The cam lobe 5*a* of the high-speed cam 5 is larger than the cam lobe 3*a* in radial projection. The second low-speed cam 4 is positioned between the first low-speed cam 3 and the high-speed cam 5. The first and second cam followers 7, 8, which engage the intake valves 1*b*, 1*a*, respectively, are held in sliding contact with the first and second low-speed cams 3, 4, respectively. The third cam follower 9 slidingly contacts the high-speed cam 5. The intake valves 1*a*, 1*b* are controlled in different speed ranges by the mechanism shown in FIGS. 4 through 6 or FIGS. 7 and 8. In the low-speed range, the intake valves 1*a*, 1*b* are operated by the respective first and second low-speed cams 3. In the medium-speed range, the intake valves 1*a*, 1*b* are operated by the first low-speed cam 3, if the mechanism of FIGS. 4–6 is used. In the high-speed range, the intake valves 1*a*, 1*b* are operated by the high-speed cam 5.

While the intake valves 1*a*, 1*b* are shown as being operated by each of the valve operating mechanisms, exhaust valves may also be operated by the valve operating mechanisms according to the present invention. In such a case, unburned components due to exhaust gas turbulence can be reduced in low-speed operation of the engine, whereas high engine output power and torque can be generated by reducing resistance to the flow of an exhaust gas from the combustion chamber in high-speed operation of the engine.

Although certain perferred embodiments have been shown and described, it should be understood that many changes and modifications may be made therein without departing from the scope of the appended claims.

We claim:

1. A valve operating mechanism for operating a plurality of valves of an internal combustion engine, comprising:

a camshaft rotatable in synchronism with rotation of the internal combustion engine and having an array of three cams each having a different cam profile and including a high-speed cam position at one end of said array;

three cam followers held in sliding contact with said cams, respectively, for operating the valves according to the cam profiles of said cams; and means for selectively interconnecting and disconnecting said cam followers to operate the valves at different valve timings in different speed ranges of the internal combustion engine, said speed ranges including a high-speed range in which all of the valves are controlled by the cam profile of said high-speed cam.

2. A valve operating mechanism according to claim 1, wherein said three cams include low- and medium-speed cams and said high-speed cam, said medium-speed cam being positioned between said low- and high-speed cams, said cam followers including two cam followers slidably engaging said low- and medium-speed cams, respectively, for operating said valves, said means including means for operating the valves selectively in a low-speed range with said low- and medium- speed cams.

3. A valve operating mechanism according to claim 1, wherein said three cams include low- and medium-speed cams and said high-speed cam, said low-speed cams, said positioned between said medium- and high-speed cams, said cam followers including two cam followers slidably engaging said low- and medium-speed cams, respectively, for operating said valves, said means including means for operating the valves selectively in a low-speed range with said low- and medium- speed cams.

4. A valve operating mechanism according to claim 1, wherein said three cams include low- and medium-speed cams and said high-speed cam, said low-speed cams, said cam followers including two cam followers slidably engaging said low- and high-speed cams, respectively, for operating said valves, said means including means for operating the valves selectively in a low-speed range with said low- and high- speed cams.

5. A valve operating mechanism according to claim 1, wherein said three cams include low- and medium-speed cams and said high-speed cam, said medium-speed cam being positioned between said low- and high-speed cams, said cam followers including two cam followers slidably engaging said low- and high-speed cams, respectively, for operating said valves, said means including means for operating the valves selectively in a low-speed range with said low- and high- speed cams.

6. A valve operating mechanism according to claim 1, wherein said three cams include two identical low-speed cams and said high-speed cam, said low-speed cams being positioned adjacent to each other, said cam followers including two cam followers slidably engaging said low-speed cams, respectively, for operating said valves, said means including means for operating the valves selectively in a low-speed range with said low-speed cams.

7. A valve operating mechanism according to claim 1, wherein said three cams include low- and medium-speed cams and said high-speed cam, said low-speed cam being positioned between said medium- and high-speed cams, said cam followers including a cam follower slidably engaging said low-speed cam for operating said valves, said means including means for operating the valves selectively in a low-speed range with said low-speed cam.

8. A valve operating mechanism according to claim 1, wherein said three cams include low- and medium-speed cams and said high-speed cam, said medium-speed cam being positioned between said low- and high-speed cams, said cam followers including a cam follower slidably engaging said medium-speed cam for operating said valves, said means including means for operating the valves selectively in a low-speed range with said low-speed cam.

9. A valve operating mechanism according to claim 1, wherein said three cams include two different low-speed cams and said high-speed cam, said low-speed cams being positioned adjacent to each other, said cam followers including two cam followers slidably engaging said low-speed cams, respectively, for operating said valves, said means including means for operating the valves selectively in a low-speed range with said low-speed cams.

10. A valve operating mechanism according to claim 1, wherein said three cams include low- and medium-speed cams and said high-speed cam, said medium-speed cam being positioned between said low- and high-speed cams, said cam followers including two cam followers slidably engaging said low- and medium-speed cams, respectively, for operating said valves, said means including means for operating the valves selectively in a low-speed range with said low- and medium- speed cams in a medium-speed range with said low- and high-speed cams.

11. A valve operating mechanism according to claim 1, wherein said three cams include low- and medium-speed cams and said high-speed cam, said low-speed cam being positioned between said medium- and high-speed cams, said cam followers including two cam followers slidably engaging said low- and medium-speed cams, respectively, for operating said valves, said means including means for operating the valves selectively in a low-speed range with said low- and medium- speed cams and in a medium-speed range with said medium- and high-speed cams.

12. A valve operating mechanism according to claim 1, wherein said three cams include low- and medium-speed cams and said high-speed cam, said low-speed cam being positioned between said medium- and high-speed cams, said cam followers including two cam followers slidably engaging said low- and high-speed cams, respectively, for operating said valves, said means including means for operating the valves selectively in a low-speed range with said low- and high- speed cams and in a medium-speed range with said medium- and high-speed cams.

13. A valve operating mechanism according to claim 1, wherein said three cams include low- and medium-speed cams and said high-speed cam, said medium-speed cam being positioned between said low- and high-speed cams, said cam followers including two cam followers slidably engaging said low- and high-speed cams, respectively, for operating said valves, said means including means for operating the valves selectively in a low-speed range with said low- and high- speed cams and in a medium-speed range with said medium- and high-speed cams.

14. A valve operating mechanism according to claim 1, wherein said three cams include two identical low-speed cams and said high-speed cam, said low-speed cams being positioned adjacent to each other, said cam followers including two cam followers slidably engaging said low-speed cams, respectively, for operating said valves, said means including means for operating the valves selectively in a low-speed range with said low-speed cams and in a medium-speed range with one of said low-speed cams and said high-speed cam.

15. A valve operating mechanism according to claim 1, wherein said three cams include low- and medium-speed cams and said high-speed cam, said low-speed cam being positioned between said medium- and high-speed cams, said cam followers including a cam follower slidably engaging said low-speed cam for operating said valves, said means including means for operating the valves selectively in a low-speed range with said low-speed cam and in a medium-speed range with said medium-speed cam.

16. A valve operating mechanism according to claim 1, wherein said three cams include low- and medium-speed cams and said high-speed cam, said medium-speed cam being positioned between said low- and high-speed cams, said cam followers including a cam follower slidably engaging said medium-speed cam for operating said valves, said means including means for operating the valves selectively in a low-speed range with said low-speed cam and in a medium-speed range with said medium-speed cam.

17. A valve operating mechanism according to claim 1, wherein said three cams include two different low-speed cams and said high-speed cam, said low-speed cams being positioned adjacent to each other, said cam followers including two cam followers slidably engaging said low-speed cams, respectively, for operating said valves, said means including means for operating the valves selectively in a low-speed range with said low-speed cams and in a medium-speed range with one of said low-speed cams.

* * * * *